US006299694B1

(12) United States Patent
Ma

(10) Patent No.: US 6,299,694 B1
(45) Date of Patent: Oct. 9, 2001

(54) PROCESS FOR SEPARATION OF GLUCOSE AND FRUCTOSE

(76) Inventor: Hsien-Chih Ma, 15 Continental Rd., Morris Plains, NJ (US) 07950

( * ) Notice: Subject to any disclaimer, the term of this patent is extended or adjusted under 35 U.S.C. 154(b) by 0 days.

(21) Appl. No.: 09/756,255

(22) Filed: Jan. 8, 2001

Related U.S. Application Data

(63) Continuation of application No. 09/274,708, filed on Mar. 23, 1999, now abandoned.

(51) Int. Cl.[7] ..... C13D 13/14

(52) U.S. Cl. ..... 127/46.2

(58) Field of Search ..... 127/46.2

*Primary Examiner*—David Brunsman

(57) ABSTRACT

For sakes of eliminating displacement zone and fully utilizing the void volume in traditional chromatography, a separation process herein disclosed is for better efficiency in separation of mixed solution of glucose and fructose into glucose and fructose solution. More specifically, the process implements a new mass transfer method onto an alkaline-earth metal cation exchanger bed for proceeding like SMB process, yet, in a single bed or multiple beds in a bundle with batch operation mode. Said new method further integrates with differential set-up protocols between solid phase resin and a multiplicity of liquid mixtures, an operation protocol to implement all above indicated methods. By the virtue of said new mass transfer method and differential set-up, the process herein disclosed is capable of separation of glucose and fructose feed solution into 100% yield of respective pure component. Said process is operated by sequential proceeding of feeding, fractions recovery, and enhancing concentration of separated fractions. The disclosed process cutbacks nearly 50% of resin stock compared with same throughput of SMB process having separation of 88% recovery of 90% fructose purity in product stream.

25 Claims, 10 Drawing Sheets

PROCESS FOR SEPARATION OF GLUCOSE AND FRUCTOSE

This is a continuation of application of Ser. No. 09/274,708 filed on Mar. 23, 1999 now abandoned.

BACKGROUND OF THE INVENTION

1. Technical Field

This disclosure relates to a process for separating components from a feed solution of glucose and fructose mixture into liquid glucose and liquid fructose for producing high fructose corn syrup (HFCS), wherein the feed solution is obtained from preceding operation. It employs a new mass transfer method, a method that is different from traditional packed bed process, to eliminate displacement zone and fully utilize void volume in batch chromatography to retrieve glucose and fructose solution and meanwhile to elevate the concentration level of retrieved solutions.

2. The Description of Prior Art

It is known that the batch process been commonly used for separation between glucose and fructose contained in a feed solution is by inputting such feed solution through a fixed bed of cation exchange column, then, following by a de-ionized water to attain such purpose. As taught by U.S. Pat. No. 3,044,904, U.S. Pat. No. 4,472,203, U.S. Pat. No. 4,395,292, Japanese Pat. No. 24,807 of 1970 and many other unlisted disclosures, without exceptions, the separation is carried out through so-called chromatography, which is a long column packed with a stationary resin. The separation is achieved through resembling mass transfer phenomenon or mechanism that the eluent water is flowing through a part of the stationary resin together with the feed solution, in a zone so-called mass transfer zone. As such mass transfer zone being transported by continuous pushing the eluent water behind the feed solution, the fructose contained in the feed solution is been retained by the resin to a greater degree than glucose. At any instance of chromatographic operation, the part of resin contributed for such separation is only when the zone passed by, while the remaining of resin is idling. By pushing such eluent water behind the feed solution, the so-called displacement zone, which contributes nothing for separation, is emerged first as the eluent water pushes off previously introduced feed solution through resin bed in order to proceed separation within said mass transfer zone. Given that various methods and processes were developed through said mechanism, the chromatography has been broadly recognized and implemented as the standard separation method that has unavoidably inherited with aforementioned shortcomings for not being efficiently utilizing the resin. Mainly because such fundamental mechanism has not been further improved, therefore, the chromatography could consume resin and eluent more efficiently and yet could gain better separation. In fact, several factors briefly illustrated afterward are multifaceted coexisted affecting one another and are responsible for those imperfections experienced in traditional chromatographic operation.

Inefficient usage of resin as previous illustration, the mass transfer proceeds only at the very front end of mass transfer zone, thus the remaining resin prior to and after such zone are idle;

Due to the existence of displacement zone to create excess dilution and to increase cycle time, and thus, even further enhances inefficient usage of resin;

Native engineering drawbacks of column process are listed as following;

1. Flow dynamics: axial dispersion, diffusion effects and back mixing of column end effects are primary factors in deteriorating the separation quality.

2. Column geometry: in and out column end-effects plus dead volume in fluid delivery further enhance the effects of flow dynamics.
3. Loading limitation: due aforementioned flow dynamics, loading limitation is unavoidably imposed to avoid peak broadening, overlapping, and tailing to compromise with separation quality.

Requires longer cycle time to further weaken effective consumption of resin and eluent, to further intensify said engineering drawbacks; and Exhibits high-pressure drop and difficulty in maintenance, as huge throughput demand requires relative increment of resin inventory.

An improved simulated moving bed process, abbreviated as SMB, is taught in both Japanese Provisional Patent Publication No. 26336 of 1978 in which zeolite is used as resin and Japanese Provisional Patent Publication No. 88355 of 1978 in which a cation exchange resin is used. The process compromises multiple columns connected in series, each column has its distributors to allow fluid to flow into and out of such column. Actually, each column in such series connection represents a particular mass-transfer task compared to a long column to carry out all tasks in sequence. At a setting time interval, all points of feed loading, eluent introducing, product and by-product withdrawals are shifted simultaneously purposely for cutting down resin and eluent consumption. Unlike rapid virtue of high ion mobility and electrical actions in water ion exchange reactions, the glucose and fructose separations are very slow. These sugars are non-electrolytes and the separation is governed by a very narrow difference interaction between resin and the dissolved sugar components in feed solution. An additional factor in affecting such interaction difference is water content within the mobile phase. It undermines such interaction to minimal when too much water exists due sugars are very soluble in water. Despite various difficult natures, the general practice of SMB operates at a flow rate of 0.8 to 1.0 bed-volume per hour, so that, the separation can be attained based on small interaction difference between sugar components and resin. In the other words, the process takes 1 to 1.25 hours to complete a separation cycle. Nevertheless, the loading limitation is set between a ratio of 0.05 and 0.1 feed-rate to resin bed volume as the operation guideline for obtaining acceptable separation quality versus operation efficiency. For example, a feed input rate of 200 gallons per minute will consume 2000 gallons of resin per minute based on a ratio of 0.1 feed-rate to resin bed volume. For a 1 to 1.25 hours cycle time, it will consume between 120,000 and 150,000 gallons of resin. In viewpoints of excess resin being used in chromatographic process, excess eluent has to be coped in order to push off the separated fractions. It surprisingly consumes about two times of eluent water as feed input rate. Overall speaking, the SMB process is far superior to a single fixed bed process in aspects of resin consumption and operation efficiency between product yield and separation quality. Therefore, it has been overwhelmingly adopted as the standard industrial process ever since was first introduced. However, this process is still limited by using general mechanism in chromatography with attempting in manipulating the column configuration and optimization in fluid distribution, in which the process still inherits the aforementioned native engineering drawbacks. Process disclosed herein proceeds like SMB, and yet, in a single bed or multiple beds in a bundle, through which conducts as a batch operation mode. Furthermore, when this disclosure compares with SMB, it aims to consume much less resin and eluent to gain the separated glucose and fructose in a much higher concentration with ultimate purity and yield, but in a much lower production cost.

SUMMARY OF THE INVENTION

In view of the foregoing shortcomings in applying mass transfer mechanism in chromatography for glucose and fructose separation, it raises an essentiality to fundamentally renovate old mass transfer mechanism. The resin used in traditional chromatography is a type of alkaline earth metal base strongly acidic cation exchanger and calcium base is the one being well adopted. This invention uses same resin for easy comparison. Concisely illustration of objects of this invention is accomplished by separating the feed solution in 100% yield into pure form of liquid glucose and fructose through a cutback of resin and eluent consumption. The process is accomplished through the integration of a new mass transfer method, a differential set-up between resin and liquid phases, an operation protocols, and an apparatus to implement all above indicated methods.

It is, therefore, a fundamental object of this invention to initiate a new mass transfer method different from that observed in chromatography by eliminating the displacement zone and further utilizing the void volume available for prompt mass transfer proceeding. Such said method in general composes at least one of following procedures.

1. Retain solid phase material in a cell having an inlet on top side and an outlet on bottom side with meshed filter to retain said material from being drained.
2. Intermittently deliver an amount of liquid phase material to wet a part of solid phase material during a first time period.
3. Intermittently supply pressurized gas to the cell on the inlet side following each delivery of a liquid material during a second time period to increase the flow rate of delivered liquid through said material to complete expected mass transfer to promote absorption of dissolved components in liquid phase material onto said solid phase material and/or elution of absorbed components from said solid phase material.
4. Maintain a vacuum on the outlet side of solid phase material to maintain said material in a semi-dry status or partial dry status, wherein partial dry status is defined as majority of the delivered liquid material having been drained off in parts by the vacuum and pressurized gas during the second time period.
5. Intermittently collecting most of treated solution from the outlet of cell during a third time period.
6. Total time spent from steps 2 to 5 is defined as minimal time interval.

An apparatus, installed with same resin installed in traditional chromatography, comprises a cell or multiple cells in a bundle with top opening to receive the fluid and bottom meshed filter to retain said resin from being drained. Said cells are disposed in a heating jacket with insulation and all cells' top-opening are exposed in a confined compartment having pressurized air inlet and dosing showerhead for liquid delivery. Predetermined amount of one kind of liquid among all liquids arranged in a specified order, including recycled streams, feed solution, and eluent water, is intermittently delivered from a particular holding tank during a specified time zone into cell's top opening via said showerhead to sprinkle a wetted region of retained resin. Such delivered liquid is instantaneously settled and drained by pressurized gas applied from top of cell and vacuum exerted from bottom of cell to maintain resin in a semi-dry status. The whole time, the drained liquid from cells is collected through curved chamber and drained into designated holding tank for further distribution. The whole time, the air exited from the apparatus is conducted through a jacket condenser to condense the vapor before entering a vacuum pump. The apparatus repeats repeatedly with liquid filling, liquid draining and collecting through said means during every spent of said minimal time interval.

It is an object of the invention to maximize the utilization of resin installed in each cell. The amount of resin installed in each cell is equivalent to resin of mass transfer zone (abbreviated as MTZ) in traditional chromatography. It means the resin installed in loading stage is completely saturated with feed solution. In chromatography, this MTZ is the resin been saturated with feed in about 5 to 10% of bed volume and transported by the eluent from one end to emerge through the other end of the column to achieve separation.

It is an object of the invention to establish differential set-up protocols amoung all kinds of solutions by taking the advantages from eliminating the displacement zone and fully utilizing void volume to efficiently reducing cycle time compared with chromatography. Briefly characterized thereafter are methods for said protocols by obtaining from a single cell study through sequential and intermittent delivery of predetermined amount of said all liquids via said new mass transfer method. The characteristic elution profiles related with the single cell study are extensively illustrated afterward in experimental examples. Said elution profile represents a steady profile that contains a raffinate, a product, and a multiplicity of recycle streams. Break down said profile in time domain with each partial time required for respective input liquid solution as particular time zone for such liquid delivery. Divide each partial time by said minimal time interval to obtain the number of doses of input for such solution. Then, divide the volume of such solution by said number of doses to obtain the partial volume required for each dose. Further divide said resin derived from complete saturation with feed solution by a number that corresponds to a group of cells to simultaneously receive the volume of such liquid dose evenly distributed onto said group of cells. Prepare sufficient amount of volume for respective liquid solution to store in a holding tank for supporting liquid distribution in single stage recycle procedures.

It is a further object of the invention to establish single stage recycle procedures, according to said differential set-up protocols corresponding to the selected elution profile, onto said apparatus to proceed batch separation and enhance concentration of fractionated mixtures while cutting down the eluent consumption. Said recycle procedures are proceeded by sequentially inputting streams of feed solution, eluent water, and recycled streams from respective holding tank into said apparatus via said new mass transfer method. Consequently, this disclosure ultimately separates a feed stream into two streams, each in 100% yield of pure composition of glucose and fructose contained in feed solution; and a multiplicity of recycled streams in stable composition and concentration of glucose and fructose liquid mixture. Yet, it is optional that this disclosure may choose to separate the feed stream into a less purity than pure liquid glucose and fructose solution as raffinate of glucose enriched solution and product of fructose enriched solution, wherein such alternative and related differential set-up protocol can be well observed in the experimental examples.

BRIEF DESCRIPTION OF THE DRAWINGS

The above and other objects, distinct features and merits of the present invention can be more readily explained from the following illustration, taken with drawings and examples in which.

DETAILED DESCRIPTION OF THE PREFERRED EMBODIMENTS

Figure 2:
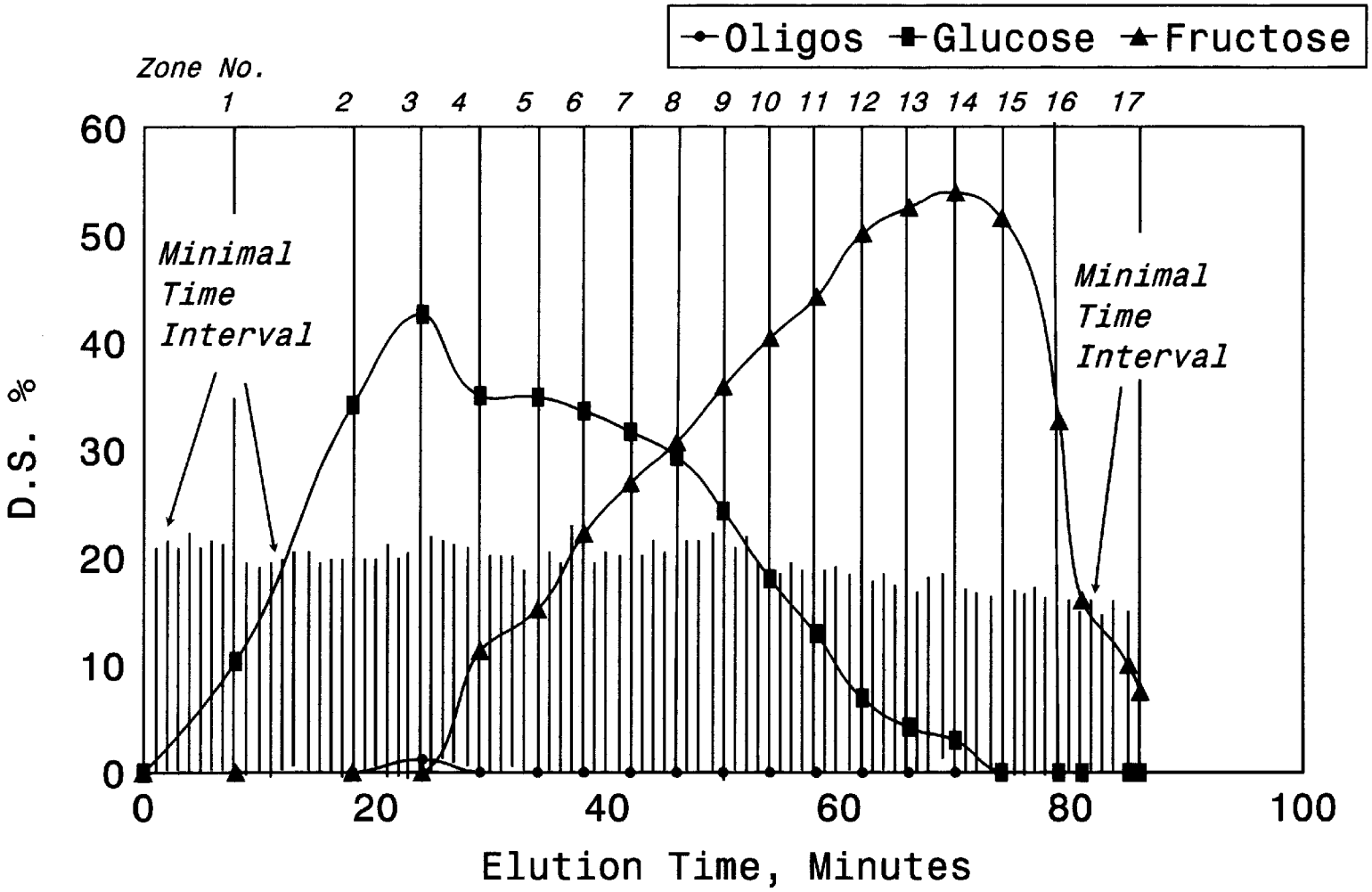
FIG. 2 shows the concentration profile from a single cell study of 17-zones protocol in which glucose, fructose, and oligosaccharide are plotted as D.S. percentage vs. elution time, wherein the pure glucose and fructose stream are retrieved respectively from a feed stream.
Figure 3:
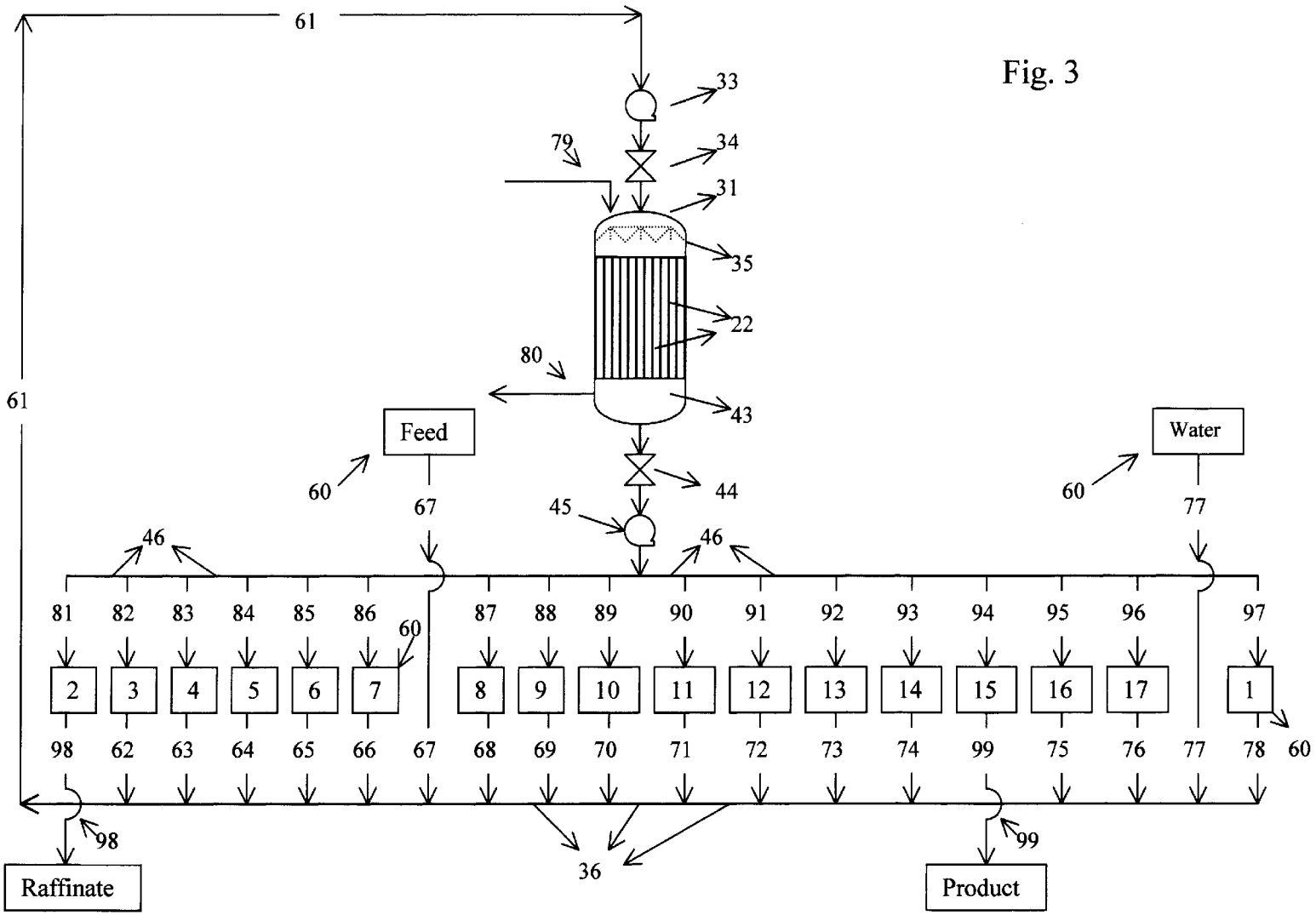
FIG. 3 shows a schematic diagram for converting the elution profile illustrated in FIG. 2 into a batch mode single-stage recycle process.

The present invention relates to a batch process for separating mixture solution of glucose, fructose, and oligosaccharide from a feed solution containing the same. This process is carried out in an apparatus to incorporate with new mass transfer method, differential set-up between solid and liquid phase, and recycle procedures. Three preferred embodiments of the current disclosure will be illustrated hereafter namely as an apparatus shown in FIG. 1. The protocols demonstrated in FIGS. 2 and 3 are employed onto the apparatus for a batch separation of recovering pure glucose and fructose stream from a feed stream. In addition, FIGS. 4 through 10 is examples illustrated for procedures obtaining the result shown in FIG. 2 proceeded under said new mass transfer method.

The bonding capacity measurement of semi-dry status resin is fundamental, wherein the resin is first washed with de-ionized water, a water containing dirt-free and ions free that could hinder the bonding capacity of the resin, and followed to treat with vacuum to remove excess water between grains of resin. Said measurement is achieved by adding fixed increment of resin to a prefixed volume of feed solution to promote complete absorption of dissolved sugar components onto the resin. The total amount of resin consumed in resin capacity measurement is the optimal amount that can be proportionally increased with the process throughput for mass production scale. In fact, the determined amount of resin is equivalent to that in mass transfer zone (MTZ) of a chromatographic operation. Such optimal quantity of resin is installed in a cell or equally divided into multiple cells as a bundle of cells disposed in the apparatus. Each cell has an inlet on topside and an outlet on bottom side of the cell equipped with a meshed filter to retain said resin from being drained.

In a batch chromatographic operation, the MTZ is shifting along with fluid stream by inputting additional mobile phase to push off such zone from one end traveling toward the other end of column. The time spent corresponding to pushing off an emerged liquid volume is known as the displacement-zone; wherein the stationary resin contained in chromatography is constantly maintained in wet status. The mass transfer is conducted as the mobile phase pass by the stationary resin. Unlike the chromatographic operation, this invention is to initiate a new mass transfer method, a mechanism that is different from those observed in chromatography, to further utilize the void volume available for prompt mass transfer proceeding by eliminating such displacement zone and maintaining resin in a semi-dry status. Said method composes of at least one of the following general procedures.

1. Retain a cell containing an amount of semi-dry status solid phase material equivalent to MTZ in chromatography; the inlet of cell is from top and the outlet of cell is from bottom.
2. Intermittently deliver the liquid material to wet a part of solid phase material during a first period of time.
3. Intermittently supply pressurized gas or air to the cell on the inlet side following each delivery of a liquid material during a second period of time to increase the flow rate through solid phase material to promote absorption of dissolved components in liquid material onto solid phase material and/or elution of absorbed components from solid phase material to return to mobile phase liquid material.
4. Maintain a vacuum on the bottom side of said solid phase material to maintain it in a semi-dry status; a status is defined as that most of the delivered liquid material having been drained off in parts by the vacuum and pressurized gas during the step 3.
5. Intermittently collect the most of treated mobile phase liquid material from the outlet of cell during a third period of time.

Total time spent from steps 2 through 5 is defined as minimal time interval, $\Delta t$. In the event, for separation of glucose and fructose, the above-indicated step 2 is conducted by input S-I mode. It means all mobile phases including feed solution, eluent water and recycle streams, of which condition remains unchanged, as step input. The total volume of such mobile phase is subdivided into several predetermined doses and sequentially delivered within a shortest time domain as a form of impulse input. Such liquid is delivered via a showerhead as described in step 2 to sprinkling onto the solid phase material, the resin, to form a partially wetted region for instantaneous and heterogeneous mass transfer contact during the steps 3 and 4 between the delivered liquid and retained resin in the cell. Consequently, the treated liquid material is collected in step 5 during each successive minimal time interval covered between steps 2 through 5. Alternatively, the delivered liquid material flows either with or without pressurized gas in step 3 or flows without vacuum and pressurized gas in step 4; which flows by gravity.

Figure 1:
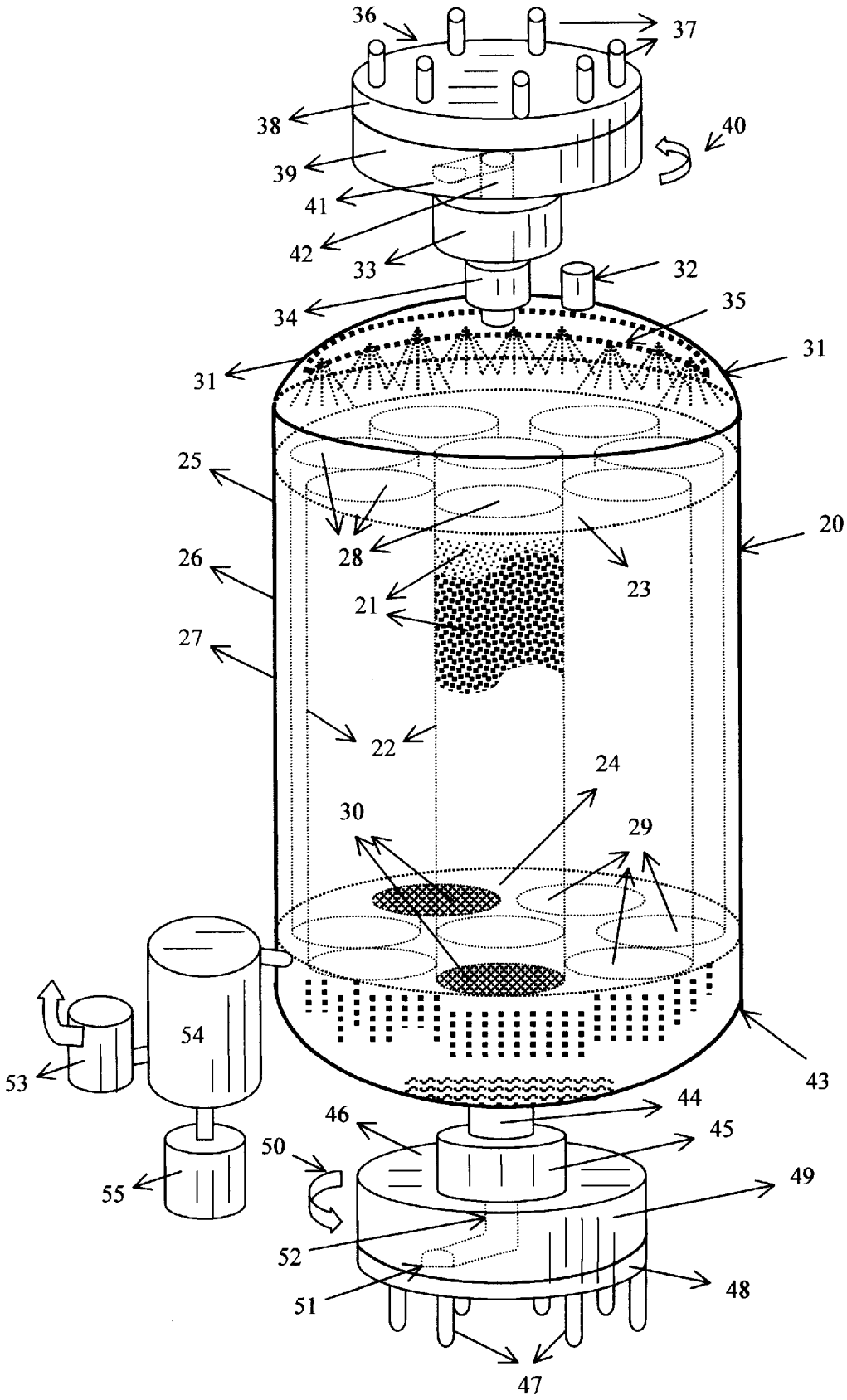
FIG. 1 is perspective view of preferred apparatus for the separation of said sugar mixtures.

FIG. 1 represents a preferred version of apparatus 20 as the batch separation process for glucose and fructose, wherein calcium base strongly acidic cation exchanger 21 is disposed in multiple cells 22 arranged in a bundle of eight. There is no limitation for the number of cells arranged as a bundle; it can be just one or other number, which is arbitrarily selected for illustration and in fact is related with process throughput. Said cells are evenly mounted with respective hole on a upper circular plate 23 and lower circular plate 24, which are sealed onto two ends of a cylindrical roll 25, having a heating fluid flowing freely in a constant temperature heating jacket 26 and insulation 27, not shown for simplicity in drawing. Each cell has an open top-inlet 28 and bottom-outlet 29, equipped with meshed filter 30 to retain said resin. Said top-inlets 28 are covered over by a compartment 31 having an external pressurized-air inlet 32, and a pump 33 connected to an on/off control valve 34 for liquid handling. A showerhead 35 is connected to the valve 34 disposed above all top-inlets 28 inside the compartment 31 for liquid delivering. A preferred rotating multi-valve unit 36 has multiple conduits 37 disposed on a stationary disk 38 and its bottom surface is attached to an intermittently rotating disk 39 rotated in a direction 40. Said disk 39 has a grooved channel 41 disposed on its upper surface to conduct respect liquid flowing through specific conduct 37 and though central outlet 42 to connect to said pump 33 and valve 34 for sequential liquid delivery. Said bottom-outlets 29 are covered over by a concave compartment 43 having an external control valve 44 connected to a pump 45 and a preferred rotating multi-valve unit 46. Said valve unit 46 has multiple conduits 47 disposed on a stationary disk 48 and its upper surface is attached to an intermittently rotating disk 49 rotated in a direction 50. Said disk 49 has a grooved channel 51 disposed on its lower surface to conduct respect liquid flowing though central outlet 52, which is connected to said pump 45 and valve 44 for sequential liquid withdrawal from said compartment 43. A vacuum pump 53 for maintaining said resin in a semi-dry status is connected to a condenser 54, which is connected to said compartment 43 and having a tank 55 for condensed liquid collection.

The predetermined amount of one kind of liquid solutions is intermittently delivered through specific conduct 37 and rotating valve unit 36 and through said valve 34 and showerhead 35 to drizzle a partially wetted region of said resin while creating a heterogeneous contact as liquid drained through stationary resin particles. The whole time, vacuum pump 53 is engaged to continuously drain the liquid and the exit air leaving from the apparatus passes through said condenser 54 to condense vapor, such as water moisture, for reusing before entering the vacuum pump 53. Soon after the predetermined volume of liquid inputting is satisfied, the liquid delivery is shut-off and pressure air is released via inlet 32 to affiliate the liquid draining and maintain resin in a semi-dry status. The whole time, drained liquid is meanwhile gathered and flowed through rotating valve unit 46 into each corresponding holding tanks (not shown). The apparatus repeats repeatedly for sequential delivery of one kind of liquid, liquid draining, and liquid collection, until all kinds of liquid deliveries arranged in specified order are sequentially delivered. Then, another cycle of all kinds of liquid delivery is repeated as rotating valve unit 36 to completing one revolution. However, the means for liquid delivery and collection can be altered in possible alternatives, such as by using a control valve for each liquid to replace rotating valve units and still maintaining sequential liquid delivery and collection for all liquids. Yet, such alternation shall be bounded within the scope of this invention as the criterion of fulfilling requirements for said new mass transfer method.

Prior to the implementation of differential set-up between two phases onto the apparatus, a preliminary study is required through a single cell. It starts from sequentially inputting all kinds of predetermined solution mixtures via said general procedures of new mass transfer method. A preferable 17-zones steady state study is shown in FIG. 2, wherein the glucose, fructose, and oligosaccharide concentration are plotted as dry solid percentage, symbolized as D.S. %, in Y-axis vs. elution time in X-axis. The method derived for obtaining the result shown in FIG. 2 will be illustrated later in examples of FIG. 4 through FIG. 10. The steady state means the concentration and the composition of glucose and fructose mixture of respective zone showing little difference among repeated studies. The study is conducted by each increment of the minimal time interval as one minute. By the nature of said new mass transfer method, the delivered liquid is promptly been drained by said vacuum and pressurized air. The expected mass transfer phenomena is executed as the delivered liquid been drained off throughout the resin. The concentration and composition of treated solution collected as samples from bottom of such cell representing a complete separation cycle. Unlike typical chromatographic elution-profile having a displacement zone emerged prior to an elution profile. Through said mass transfer method the elution profile starting from the beginning of elution time, the displacement zone in traditional chromatographic operation has been eliminated and so is the void volume available between resin-grains has been utilized for separation. Comparing with traditional chromatography, this saving in cycle time translates a saving of resin consumption. The preferable 17-zones protocol implemented onto the apparatus is capable of recovering a raffinate of pure glucose from zone 2 in concentration ranging between 30.0 and 40.0 D.S. % and a product of pure fructose from zone 15 ranging in between 50.0 and 58 D.S. % of elevated concentration. Yet, the concentration of zone 2 can be enhanced to between 50 and 60 D.S. % by additional zone as 18-zones protocol. The total cycle time incurred for 17-zones protocol from sequential liquid delivery into said cell, including feed, eluent water, recycle solutions, and to collect drained solution from bottom of cell form zones 1 through 17 is 86 minutes.

Actually, there is no specific preference in setting up said number of cells in a bundle and number of rotation steps in valve unit 36 as one revolution to represent a complete separation cycle or number of minimal time intervals in each rotation step. It solely depends on the total time required to spent for completing one elution profile divided by the said minimal time interval, such that to simplify the procedures to minimal complexity to obtain the satisfactory separation results. In any event, therefore, other alternative protocols may be established, yet, such alternations should be confined within the scope of this disclosure. The general method of differential set-up between solid phase material and mobile phases is composed of following procedures.

1. Sequentially break down the elution profile obtained by said new mass transfer method, as demonstrated in FIG. 2, to obtain the partial time as particular time zone required for each respective mobile phase delivery, including feed solution, eluent water, and recycled streams.
2. Divide said partial required time by the minimal time interval to obtain the number of doses and divide the volume of such mobile phase by the number of doses to obtain the partial volume required for each dose.
3. Divide the resin, derived from said resin capacity measurement, by a number that represents a group of sub-cells retaining equal amount of further partial resin to simultaneously receive the said volume dose in step 2 to evenly distributing into each sub-cell in said group of sub-cells.
4. Allocate and record respective time zone required for each mobile phase in step 2 as specific time zone, which is corresponding to the duration time of each rotation step in rotating valve unit 36 that represents specific partial time needed for particular mobile phase delivery.

5. Arrange all time zones in the same order for all kind of liquids in an endless circular format on said rotating valve 36 and total integrated time zone representing a complete separation cycle.
6. Sequentially prepare whole spectrum of respective mobile phases, including feed solution and eluent water and all recycled streams, in a matching holding tank for liquid distribution during specified time zone.

FIG. 3 exemplifies single stage recycle procedures through said differential set-up protocols onto said apparatus for input of various liquids and its output distribution thereafter via respective holding tank 60 during each specified time zone. This figure outlines a 17-zones separation cycle based on one minute as a minimal time interval to reflect the profile provided in FIG. 2. In fact, one minute per interval is randomly chosen and can be in multiple as another minimal intervals, which is interpreted as a major interval to proportionally reduce number of liquid doses with modification of procedures. This figure further illustrates single stage recycle procedures for elevating the concentration level of separated fractions. All cells 22 indicated earlier in FIG. 1 are simplified by a "rectangle" located underneath said showerhead 35 disposed inside compartment 31 connected to a valve 34 and a pump 33 to intermittently receive one type of liquid dose sequentially delivered from respective holding tank 60 through rotating valve unit 36 via a common line 61. During a specified time zone, following procedures are repeatedly executed via said new mass transfer method during each successive minimal time interval for total of 86 minutes to represent a complete separation cycle, which covers all time zones arranged in specified order defined in the differential set-up protocols.

1. A predetermined volume of liquid dose from designated holding tank 60 of zone 3, 4, 5, 6, 7, feed solution, 8, 9, 10, 11, 12, 13, 14, 16, 17, eluent water, and zone 1 is intermittently and sequentially delivered during a specified time zone through pipeline of 62, 63, 64, 65, 66, 67, 68, 69, 70, 71, 72, 73, 74, 75, 76, 77, and 78, as indicated in the figure, into underneath cell's top-inlet to evenly wet partial of contained resin in a cell.
2. Intermittently deliver pressurized-air through line 79 to all cells following each delivery of liquid dose to force draining of delivered liquid through said resin to complete expected mass transfer contact between drained liquid and resin.
3. Constantly maintain a vacuum through line 80 to affiliate with pressurized-air to drain the liquid into said concave compartment 43 and meanwhile to maintain resin in a semi-dry status.
4. Intermittently and sequentially collect drained liquid during each successive minimal time interval of specified time zone from said compartment through valve 44 and pump 45 and rotating valve 46 to distribute respectively through pipeline of 97, 81, 82, 83, 84, 85, 86, 87, 88, 89, 90, 91, 92, 93, 94, 95, and 96, as indicated in the figure, into designated holding tank of zone 1, 2, 3, 4, 5, 6, 7, 8, 9, 10, 11, 12, 13, 14, 15, 16, and 17.
5. Solution collected from zone 2 is intermittently transferred via line 98 as raffinate and solution collected from zone 15 is intermittently transferred via line 99 as product.

All the aforementioned procedures are repeated during each spent of said minimal time interval, $\Delta t$, which is covered from steps 1 through 4 for a dose of one type liquid delivery. Such minimal time interval specified in FIG. 2 represents the elution profiles gained from a single cell study. Through the implementation of new mass transfer method and differential set-up protocols onto the apparatus, one rotation step on the rotating valve 36 is equivalent to completing delivery for one kind of liquid from corresponding holding tank during a specified time zone. Meanwhile, one rotation step on the rotating valve 46 is equivalent to completing collection of one kind of drained liquid into designated holding tank during same specified time zone. One concurrent revolution of both valve 36 and valve 46 represent a complete separation cycle to sequentially complete whole spectrum of liquid deliveries and collections. The feed solution is introduced via line 67 located in between recycled stream of zone 7 and zone 8, wherein feed solution has glucose content slightly lower than that in zone 7 and slightly higher than that in zone 8. As indicated by FIG. 2, the components of glucose and fructose originally contained in the feed solution are thus migrating horizontally through recycled streams toward zone 2 recovered as a raffinate stream of pure glucose via line 98, and toward zone 15 recovered as a product stream of pure fructose via line 99. Furthermore, the traditional chromatography spends extra time for pushing off the displacement zone, in which the separated component is travelling with bulk liquid flow. This invention has demonstrated the elimination of such displacement zone and therefore the cycle time is dramatically reduced, thus, the resin inventory, eluent consumption, and other unspecified operation costs could be proportionally reduced.

As earlier illustration of resin installed in each cell of apparatus is the amount of resin in mass transfer zone of a chromatographic operation, which is directly related to the maximum bonding capacity of resin. Under foregone guideline of new mass transfer method, the bonding capacity is irrelevant to dry solid percentage (D.S. %) concentration of sugar components in feed solution but is mattered with the absolute weight of bonded sugars vs. resin's bonding capacity. Thus, the feed solution can be input ranging from as low as 10 to high as 70 D.S. %. In this invention, the 60 D.S. % is selected in single cell experimental study due this concentration is the one being popularly used in SMB. In general, the higher concentration of dry solid percentage in feed solution is preferred simply because the less volume to handle.

Under same foregone guideline, the amount of de-ionized water consumed becomes irrelevant to its fluid kinetics; including fluid dynamics, flow rate, and flow pattern that are extremely critical in chromatographic operation. Note that the de-ionized water is dirt-free water and is free of ionic substances that would hinder the sorption capacity of resin contained in the cell. Because the elution profile is derived directly with a single cell study and then well implemented onto the apparatus. The amount of eluent consumed is directly related to how fast the elution is been completed during such study. Therefore, after the direct implementation of the selected profile onto the apparatus, the apparatus in fact conducts same profile simultaneously in a multiple of cells in a prompt and efficient manner as those observed in the single cell study. Apparently, the eluent water consumption is just proportionally increased from the result of single cell study. Note that the recovered water from exit vacuum air in condensing unit can be reused, which can be deducted from total water consumption.

In appreciation for new mass transfer method, the inter-resin particle fluid is been drained by vacuum to constantly maintain the resin at a semi-dry status. Traditional issues in chromatographic operation, such as resin's mesh size related to pressure loss, and related mass transfer resistance to access absorption sites in porous resin are not very important in present invention. Simply because the removal of fluid in between resin particle by vacuum exposes the area available for mass transfer to a maximum extent and thus allow the absorption and elution to proceed in a most efficient manner. A type of resin, calcium base strongly acidic cation exchanger with mean particle size of 320μm ±10μm, been broadly adopted in most industrial SMB process is chosen in this invention. It is intentionally employed for easy comparison between this invention and traditional process. In general, it is preferable in using smaller mesh size of resin particle to possess a larger available mass transfer contact area, because the pressure loss is less critical in this invention. The operation temperature is preferable in range of 60° to 85° C. to prevent microorganism growth in the apparatus and to reduce the viscosity of sugar solution for each flow in recycling procedures.

The objects and protocols of this invention can be readily comprehended from the following examples, tables, and resin inventory calculated for a specified throughput for the said process. To avoid repeated illustration in examples, the specifications of primary components are listed as following.

Feed solution: High Fructose Corn Syrup received from domestic corn refiner, having composition of Fructose 43.05%, Glucose 51.09%, and balance of Oligos, with concentration of 71.1% dry substance. This material is diluted with de-ionized water to 60% dry substance.

Resin: Dowex Monosphere 99, Calcium base strongly acidic cation exchanger with mean particle size of 320 μm±10μm.

The said feed solution and resin are investigated by single cell study, through which to distinguish the mass transfer mechanism between this disclosure and the chromatography. The cell dimension is 1.27 cm in I.D. and 203.2 cm in bed height and jacked with 65° C. water circulation. The resin is filled in bed with total 190.5 cm in height and 241 cc in bed volume. Unlike chromatography, the resin is saturated with water. The new mass transfer method is proceeded under 27 inch-Hg vacuum applied from bottom of bed to continuously drain off the inter-particles's fluid. The reservoirs of feed solution, recycled streams and eluent water are jacketed with 65° C. water circulation. All liquid inputs are simulated by a quick stroke of liquid pipette to deliver the predetermined volume of such liquid in a form of said input S-I. The bottom of bed is equipped with an airtight easy thread on and off bottle for sample collection by every prearranged time interval, which is the minimal time interval. The vapor recovery unit jacketed with circulated cold water is installed in between the bed and vacuum pump, and the condensed water will be collected from bottle installed under such condenser. In between each dose of liquid delivery, the pressurized air is supplied from top of cell to affiliate with vacuum for fast liquid draining. Those experimental features are actually set in accordance with the preferred apparatus illustrated in FIG. 1 and criterions of the new mass transfer method.

EXAMPLE 1

Figure 4:
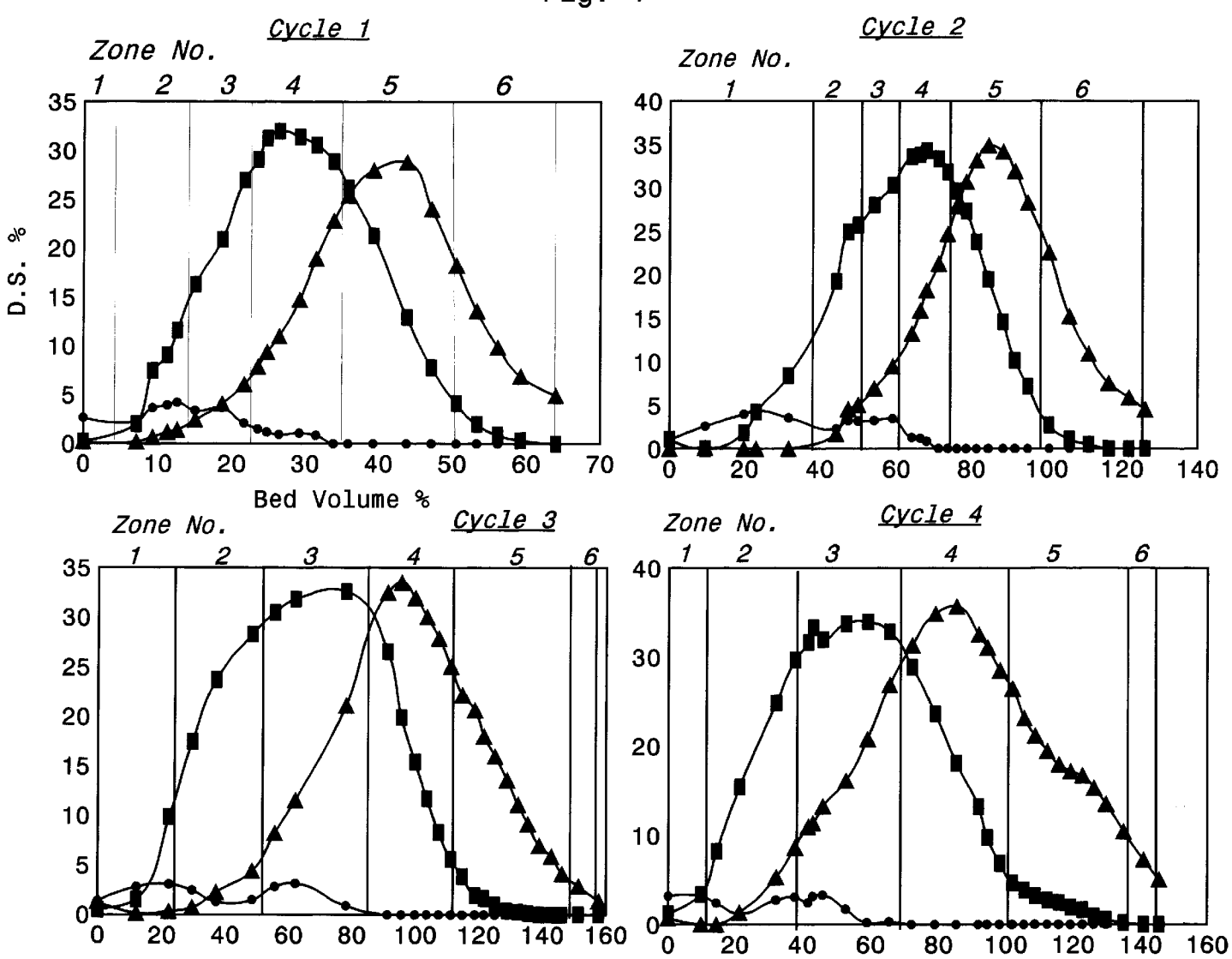
FIG. 4 shows the elution profiles of cycle 1 through cycle 4 conducted by Input S-I at a ratio of 0.25 of feed to bed volume and the steady state is obtained at cycle 4.

The FIG. 4 shows the characteristic profile of four cycles proceeded under new mass transfer method, in which each cycle's sample concentration is plotted on Y-axis as D.S. % vs. accumulated sample volume converted as Bed Volume % on X-axis. Cycle 1 has 60 cc (25% of bed volume) of feed input via a format of 2.5 cc/dose every 10 seconds per minute for 4 minutes. Total 24.8 cc of water is collected as sample #1 with majority of oligos originally existed in feed solution. This phenomenon has not been realized in traditional chromatography, mainly because the column is saturated with water and additional water will cause the bounded sugars to immediately return to surrounding mobile phase, Nevertheless, the major distinction between this disclosure and traditional chromatography is apparent in aspect of resin's adsorption capacity, through which enables resin to increase its bonding capacity many folds. This advantage benefited from said new mass transfer method would be illustrated in following examples of multiple zones, single-stage recycle procedures.

The solution collected from sample #1 is zone 1. The water elution is conducted after feed input by three formats of input S-I and meanwhile drained liquid as samples are collected. The first input format covers each water dose delivered is 1.0 cc by each 20 seconds interval for total 3 doses in every repeated one minutes interval. For simple notation, the format of input S-I can be denoted as ((1.0 cc/20 sec.)*3/min). The total water input is 3 cc per minute interval. The second format is ((1.0 cc/10 sec.)*6/min.), which is 6 cc per minute interval for six doses of 1 cc for every 10 seconds. The third format is ((1.5 cc/10 sec.)*6/min.), which is 9 cc per minute interval for six doses of 1.5 cc per 10 seconds. Details combinations of input format hereinafeter are omitted to simplify illustration. Mainly, the eluent input is adjusted in a way that to elute most of glucose as front peak and to prolong the fructose peak in farther apart from the glucose peak. As shown in cycle 1, collected samples are selectively combined as solutions of zone 1 through zone 6, which are retained as the input solution in next cycle. The cycle time is 30 minutes; consumed 157 cc of eluent water and 17 cc of condensed water is collected. The input of cycle 2 is proceeded in sequence of zones 2, 3, 4, and 60 cc of feed solution, then zones 5, 6, 124.8 cc of eluent water, and finally the zone 1 solution. Said feed solution is always delivered in between two zones, wherein zone 4 has glucose content slightly higher than that in feed solution and zone 5 has glucose content slightly lower than that in feed solution. The cycle time is increased to 36 minutes and 21 cc of condensed water is collected. The elution profile of cycle 2 has a much pure glucose region (Zone 2) in the front peak and has a much pure fructose mixture (Zone 5) in fructose peak. Likewise, the combined samples, as solutions of zone 1 through zone 6 are retained as the input solutions in cycle 3. The same sequence as those in cycle 2 is followed, which is composed of zones 2,3,4, 60 cc of feed solution, zones 5, 6, 125 cc of eluent water, and zone 1 solution. The cycle time is 36 minutes and 18 cc of condensed water is collected. Two sugars in feed solution are steadily migrating toward zone 2 as glucose enriched solution and zone 5 as fructose enriched solution. Only zone 2 solution of cycle 3 is retained as raffinate in this cycle. The remaining solutions are input for cycle 4 in sequence as zones 3, 60 cc of feed, 4, 5, 6, 90 cc of eluent water, and zone 1 solution. The cycle time is 36 minutes and 9 cc of condensed water is collected. The table 1 has listed the zone 2 solution as raffinate of glucose enriched solution and zone 5 as product of fructose enriched solution. The recovery percentage of respective sugar is defined as the weight percentage of retrieved sugar that in comparison with the original pure component in parts in feed solution. The percentage of respective sugar is defined as the weight of such sugar in parts of total output.

TABLE 1

| Zone | Total Output | D.S. % | Recovery % | Glucose % | Fructose % |
|---|---|---|---|---|---|
| 2 | 25.7318 grams | 27.58 | 83.79% of glucose | 81.14 | 18.86 |
| 5 | 17.0599 grams | 19.41 | 81.25% of fructose | 10.74 | 89.26 |

EXAMPLE 2

Figure 5:
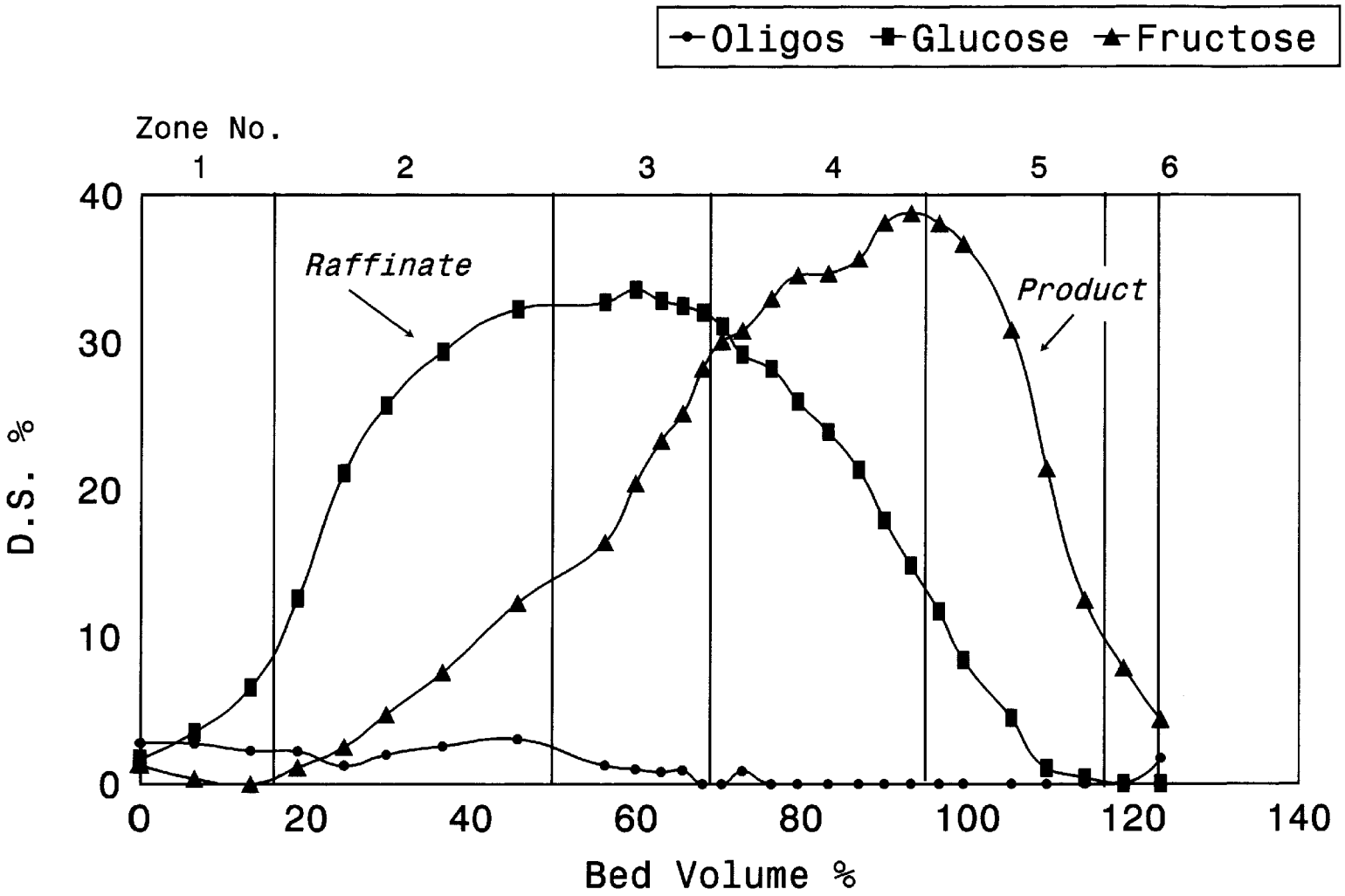
FIG. 5 represents the cycle 5, a continuation of steady state of six-zones cycle from FIG. 4, wherein a raffinate stream and a product stream are retrieved simultaneously.

The elution profile shown in FIG. 5 indicates the fifth cycle extended from cycles illustrated in previous figure. The sequence of liquid input is same as those in cycle 4 except zone 5 reserved as product, which are zones 3, 60 cc of feed, 4, 6, 96 cc of eluent water, and zone 1 solution. The cycle time is 37 minutes. Again, the solution collected from zone 2 is retained as raffinate of glucose enriched solution and the solution collected from zone 5 is retained as product of fructose enriched solution. Results are tabulated in Table 2, which demonstrates it has reached steady state that the composition and concentration are maintained constant.

TABLE 2

| Zone | Total Output | D.S. % | Recovery % | Glucose % | Fructose % |
|---|---|---|---|---|---|
| 2 | 24.3698 grams | 31.40 | 78.80% of glucose | 81.12 | 18.82 |
| 5 | 16.9526 grams | 31.20 | 86.06% of fructose | 13.8 | 86.20 |

The aforementioned examples have implied that the elution profile maintained steady after several cycles, which can be observed through material balance, in terms of outputs as number of zones been collected including raffinate, product, and streams for recycling, versus the inputs of feed solution, eluent water, and recycled streams from previous cycle. Following examples will focus on objects for establishing protocols by using a needed amount of resin, which is relevant to a particular cycle time that can obtain a specific purity and concentration as comparison criterion for raffinate and product. The steady-state elution profile is constructed by addition of two zones in concentration ranging in between 40 to 60 D.S. % into the current profile to replace the retrieved raffinate and product, wherein the composition of said zones are determined from compositions of retrieved raffinate and product stream of previous cycle. By expansion the number of zones, either emphasizing product or raffinate part, the recycled streams are increased by a selected number of zones in the next profile, usually by two zones, such that the purity and concentration of separated raffinate and product stream can be improved. Because the amount of glucose and fructose original dissolved in a mixture of feed solution is migrating through recycled streams toward two ends of respective profile and ultimately a pure glucose and fructose solution can be obtained.

EXAMPLE 3

Figure 6:
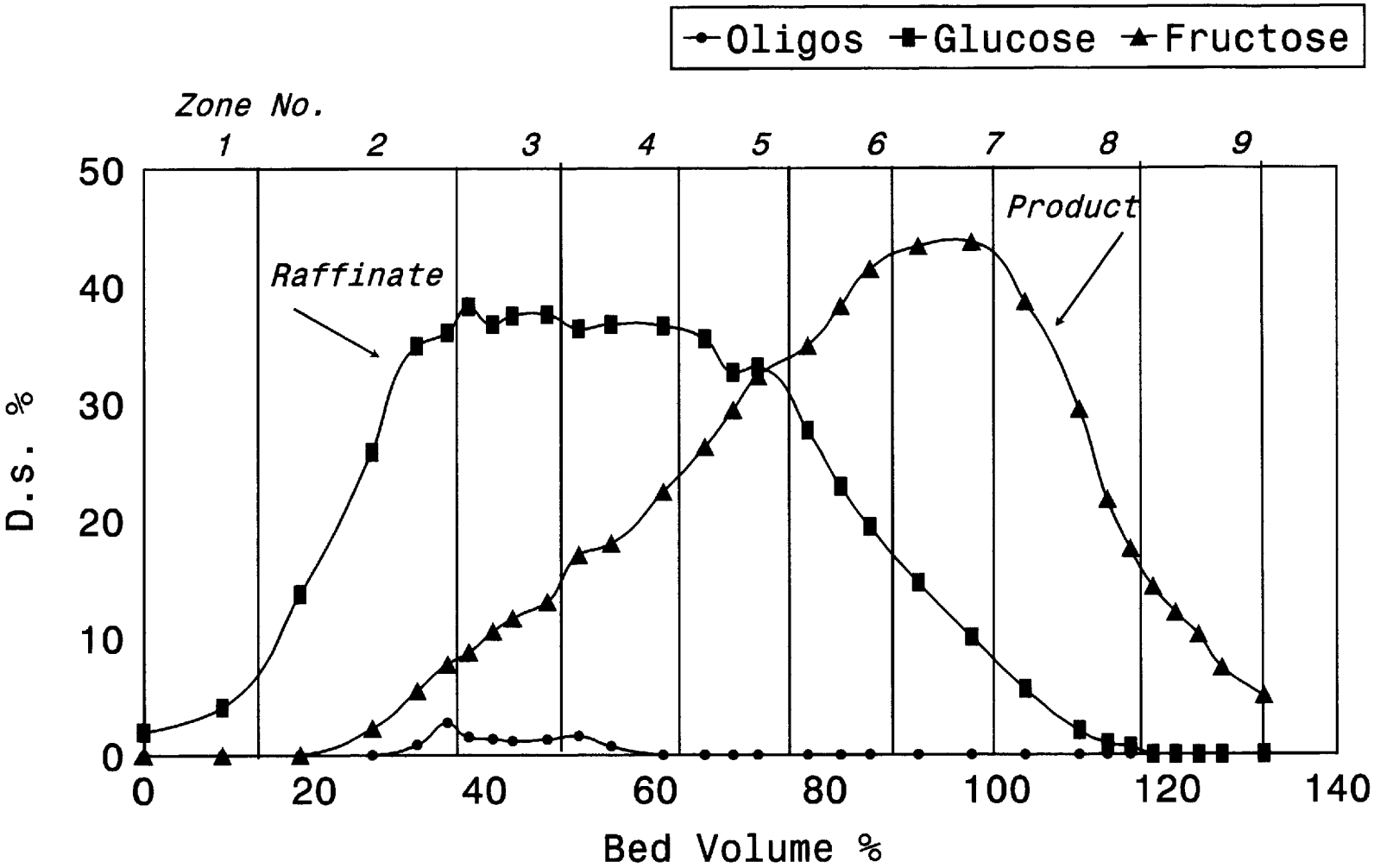
FIGS. 6, 7, 8, 9 and 10 represent steady state elution profiles of six consecutive cycles constructed by adding a raffinate zone and a product zone into current cycle wherein the composition of added zones are same as retrieved raffinate and product stream of previous cycle; and wherein FIG. 6 stands for a 9-zones profile, FIG. 7 stands for a 11-zones profile, FIG. 8 stands for a 13-zones profile, FIG. 9 stands for a 15-zones profile wherein a product stream is retrieved from zone 13 for an elevated concentration, FIG. 10 stands for a 17-zones profile wherein a nearly pure product stream is retrieved from zone 15 at an elevated concentration.

As illustrated in FIG. 6, total nine zones of liquids are collected as the results of sequential liquid input of zones 3, 4, 60 cc of feed, 5, 6, 20 cc of zone 7, 24 cc of zone 9, 120 cc of eluent water, and zone 1. All steams have predetermined sugars concentration in between 5 to 60 D.S. % and composition in accordance with results in FIG. 5. The input volume of recycled stream of other unspecified stream is 30 cc. Total 10 cc of condensed water is collected during total 50 minutes of cycle time. Alike as those demonstrated in FIG. 5 that the raffinate as glucose enriched solution is recovered from zone 2 and the product as fructose enriched solution is recovered from zone 8. Note that the cycle time is increased from 36 to 50 minutes as three addition zones are incorporated into previous profile to allow glucose and fructose to further migrate through added zones to end of respective profile. The table 3 has listed the composition and concentration of retrieved raffinate and product, which demonstrates better separation results are obtained than those in six zone protocols.

TABLE 3

| Zone | Total Output | D.S. % | Recovery % | Glucose % | Fructose % |
|---|---|---|---|---|---|
| 2 | 22.2852 grams | 29.20 | 90.40% of glucose | 89.61 | 10.39 |
| 8 | 19.8856 grams | 35.80 | 90.30% of fructose | 10.58 | 89.42 |

For avoiding repeated description, the general conditions relevant to the following examples are described hereinafter, through which the procedures can be developed for leading to the separation result demonstrated in FIG. 2. The cell dimension is 0.95 cm in I.D. and 206 cm in bed height. The resin is filled to 195.6 cm in bed height and has total bed volume of 139.6 cc. The 36 cc of feed volume are delivered in each example inasmuch as the bed volume is smaller than that in earlier examples. Yet, such 36 cc are equivalent to 25.8% of resin bed volume. Other conditions are remained unchanged as previous examples.

EXAMPLE 4

Figure 7:
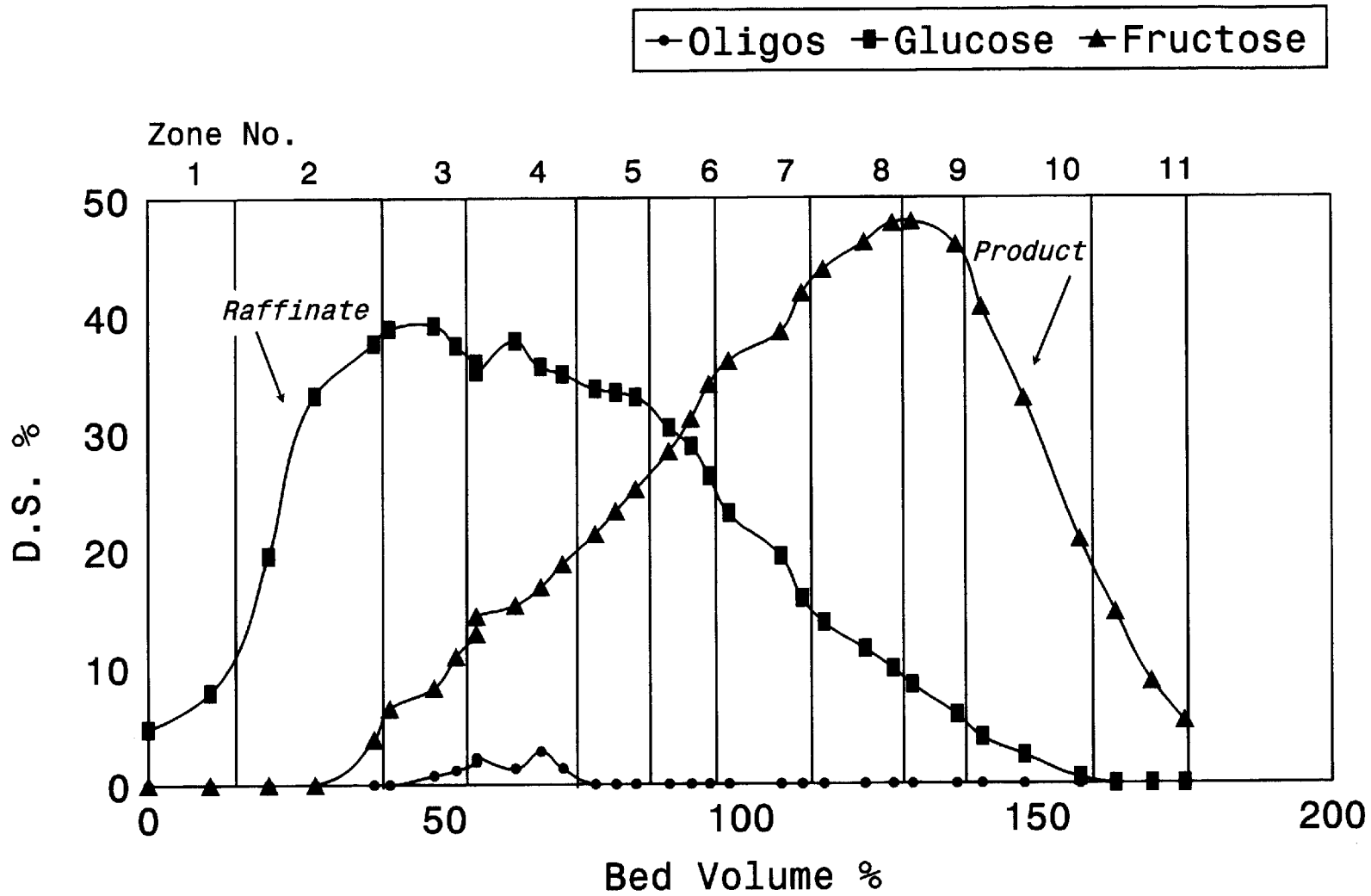

As illustrated in FIG. 7, total eleven zones of liquids are collected as the results of sequential input of liquids from zones 3, 4, 5, feed, 6, 7, 8, 9, 24 cc of zone 11, 63 cc of eluent water, and zone 1. Other unspecified input volume of recycled stream is 18 cc. Total 3 cc of condensed water is collected. In fact, the zone 3 and zone 9 are the added zones having compositions of two sugars as those specified in Table 3 of zone 2 and zone 8 respectively and each having concentration of 53 D.S. %. Other recycled streams of zones 3, 4, 5, 6, 7, 9 utilized in example 3 are renamed as zones 4, 5, 6, 7, 8, and 11 respectively with composition and concentration unchanged as liquid input indicated. Alike as those demonstrated in FIG. 6 that the raffinate as glucose-enriched solution is recovered from zone 2 and the product as fructose enriched solution is recovered from zone 10. Note that the cycle time is increased from 50 to 60 minutes as two zones are incorporated into previous profile to allow glucose and fructose to further migrate through added zones to the end of respective profile. The table 4 has listed the composition and concentration of retrieved raffinate and product, which demonstrates better separation results are obtained than those in nine zone protocols.

TABLE 4

| Zone | Total Output | D.S. % | Recovery % | Glucose % | Fructose % |
|---|---|---|---|---|---|
| 2 | 13.8567 grams | 31.23 | 93.44% of glucose | 95.43 | 4.57 |
| 10 | 12.1267 grams | 32.58 | 94.69% of fructose | 6.88 | 93.12 |

EXAMPLE 5

Figure 8:
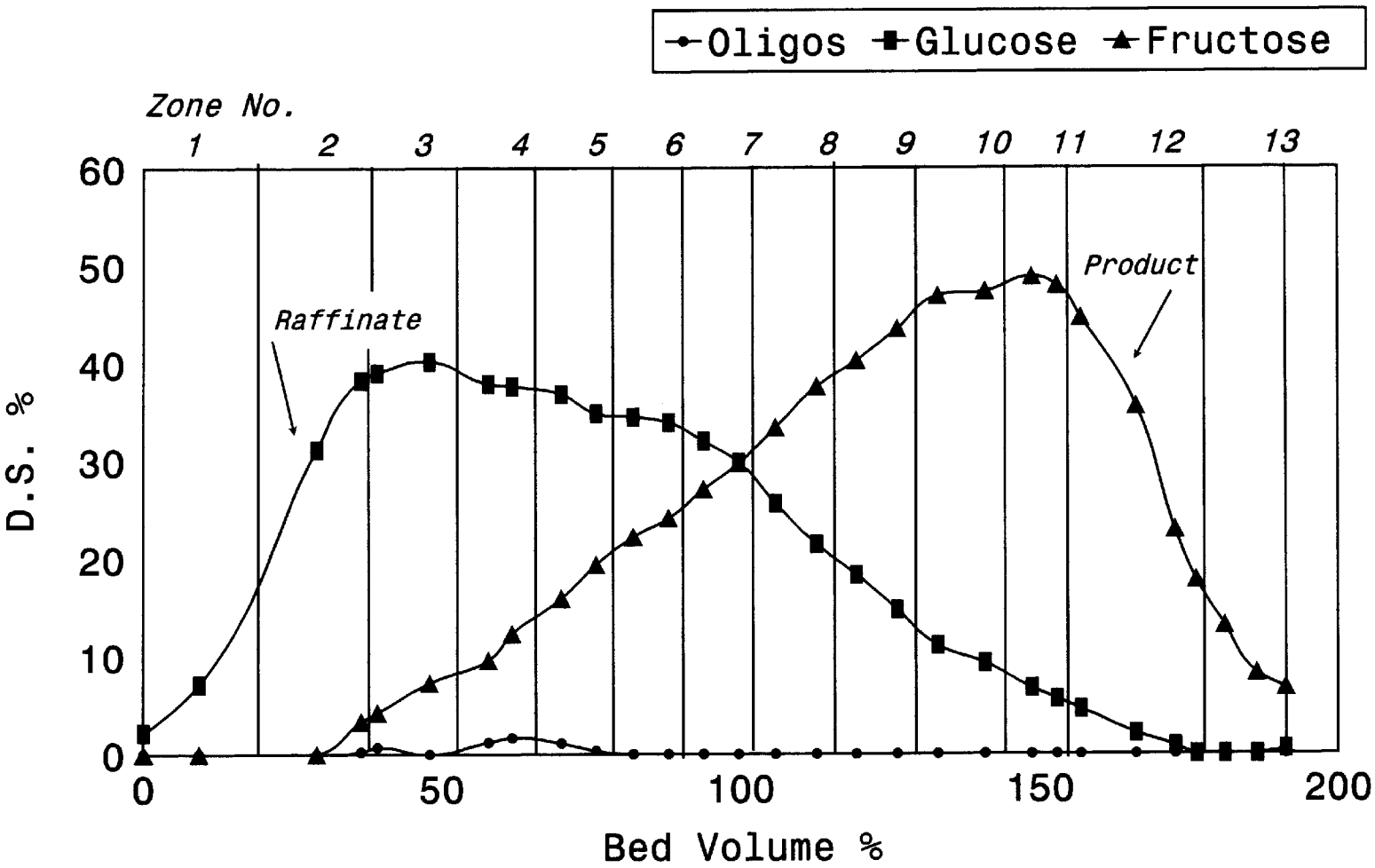

As illustrated in FIG. 8, total thirteen zones of liquids are collected as the results of sequential input of liquids from zones 3, 4, 5, 6, feed, 7, 8, 9, 10, 11, 24 cc of zone 13, 63 cc of eluent water, and zone 1. Total 3 cc of condensed water is collected. Other unspecified input volume of recycled stream is 18 cc. In fact, the zone 3 and zone 11 are the added zones having compositions of two sugars as those specified in Table 4 of zone 2 and zone 10 and each having predetermined concentration of 48 and 55 D.S. % respectively. Other recycled streams of zones 3, 4, 5, 6, 7, 9, 11 utilized in example 4 are renamed as zones 4, 5, 6, 7, 8, 10, and 13 respectively with composition and concentration unchanged as liquid input indicted. Alike as those demonstrated in FIG. 7 that the raffinate as glucose-enriched solution is recovered from zone 2 and the product as fructose enriched solution is recovered from zone 12. Note that the cycle time is increased from 60 to 68 minutes as two zones are incorporated into previous profile to allow glucose and fructose to further migrate through added zones to the end of respective profile. The table 5 has listed the composition and concentration of retrieved raffinate and product, which demonstrates better separation results are obtained than those in eleven zone protocols.

TABLE 5

| Zone | Total Output | D.S. % | Recovery % | Glucose % | Fructose % |
|---|---|---|---|---|---|
| 2 | 14.1856 grams | 34.53 | 96.50% of glucose | 97.60 | 2.40 |
| 12 | 12.4183 grams | 32.58 | 98.06% of fructose | 5.83 | 94.17 |

Following two examples are illustrated for enhancing the concentration level of product from typical concentration of 30–35 D.S. % to a higher level as 50–55 % D.S. % while the separation purity of product also enhanced. Yet, the same protocols can be applied for raffinate part to enhance the purity and concentration by addition of predetermined zone into glucose profile.

EXAMPLE 6

Figure 9:
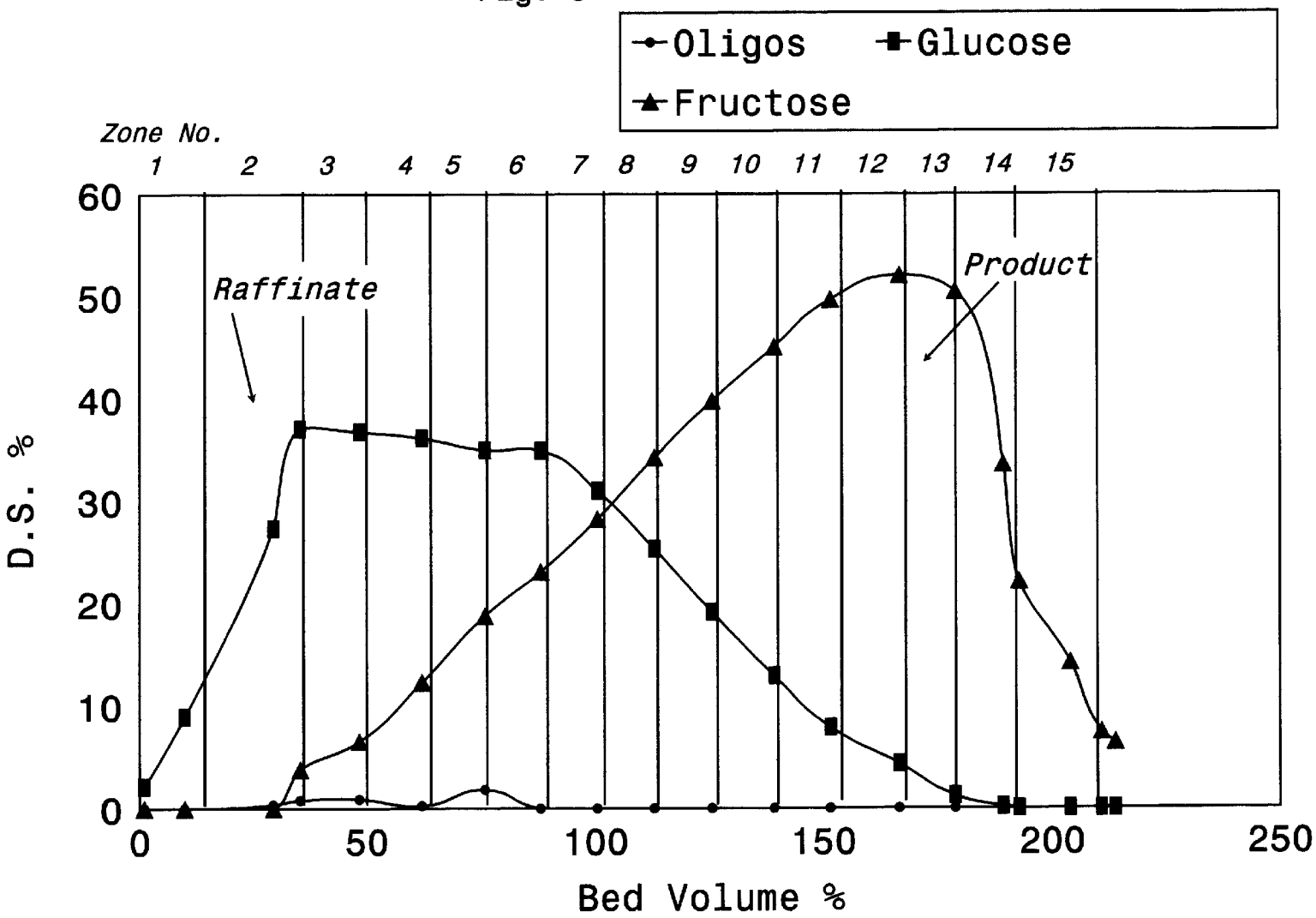

As illustrated in FIG. 9, total fifteen zones of liquids are collected as the results of sequential input of liquids from zones 3, 4, 5, 6, feed, 7, 8, 9, 10, 11, 12, 14, 21.6 cc of zone 15, 62 cc of eluent water, and zone 1. Total 5 cc of condensed water is collected. Other unspecified input volume of recycled stream is 18 cc. It is slightly different from previous examples that the zone 12 and zone 14 are the added zones. Zone 12 has compositions of two sugars as those specified in Table 5 of zone 12 with concentration at 55 D.S. % and zone 14 has composition of 100% fructose at 33 D.S. %. Other recycled streams of zones 3, 4, 5, 6, 7, 9, and 11 utilized in example 5 are with composition and concentration unchanged as liquid input indicted except zone 13 is renamed as zone 15. Slightly different from those demonstrated in FIG. 8 that the raffinate as glucose enriched solution is recovered from zone 2 and the product as fructose enriched solution is recovered from zone 13, which is the third to the last zone. Note that the cycle time is increased from 68 to 76 minutes as two zones are incorporated into previous profile to enhance improvement only on fructose to further migrate through added zones to the end of fructose profile. The table 6 has listed the composition and concentration of retrieved raffinate and product, which demonstrates a better separation on product part, plus having an elevated concentration than those in thirteen zone protocols. Note that the concentration of product is enhanced from typical concentration level of 30–35 D.S. % to 52 D.S. %.

TABLE 6

| Zone | Total Output | D.S. % | Recovery % | Glucose % | Fructose % |
|---|---|---|---|---|---|
| 2 | 14.0146 grams | 33.85 | 94.85% of glucose | 97.33 | 2.67 |
| 13 | 11.8931 grams | 52.06 | 96.03% of fructose | 2.8 | 97.20 |

EXAMPLE 7

Figure 10:
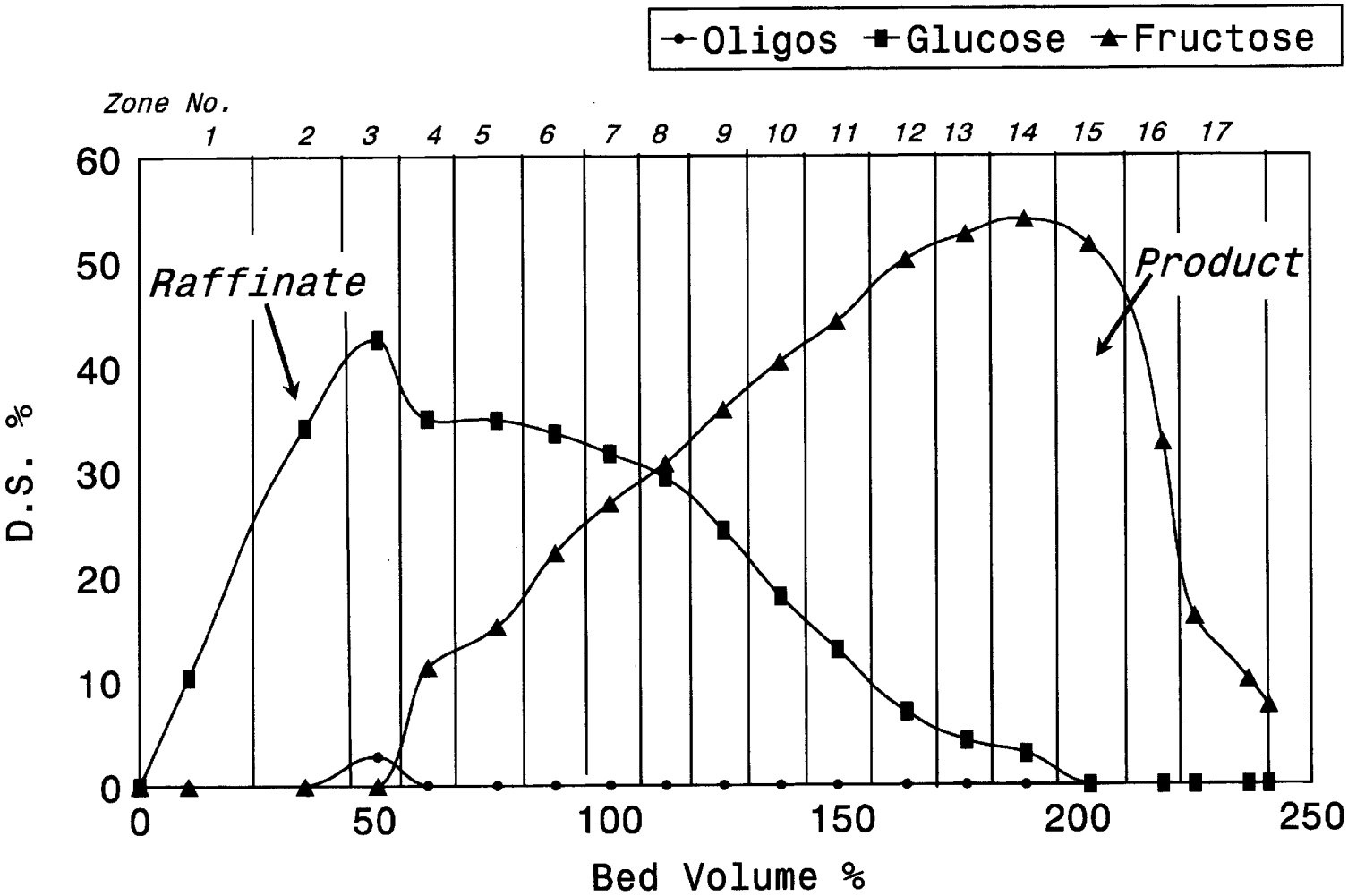

As illustrated in FIG. 10, total seventeen zones of liquids are collected as the results of sequential input of liquids from zones 3, 4, 5, 6, 7, feed, 8, 9, 10, 11, 12, 13, 14, 22.5 cc of zone 16, 25.2 cc of zone 17, 58.5 cc of eluent water, and zone 1. Total 5 cc of condensed water is collected to make net water consumption of 53.5 cc in volume. Thus, the volume ratio of water to 36 cc of feed is 1.49. Other unspecified input volume of recycled stream is 18 cc. Again; it is slightly different from example 6. The zone 3 is the added zone having compositions of two sugars as those specified in Table 6 of zone 2 and having concentration of 45 D.S. %. Zone 14 is the other added zone having composition of 95% fructose and 5% of glucose at 55 D.S. %. Other recycled streams of zones 3, 4, 5, 6, 7, 8, 9, 10, 11, 12, 14, and 15 utilized in example 6 are renamed as zones 4, 5, 6, 7, 8, 9, 10, 11, 12, 13, 16, and 17 respectively with composition and concentration unchanged as liquid input indicated. Alike as those demonstrated in FIG. 9 that the raffinate as glucose-enriched solution is recovered from zone 2 and the product as fructose enriched solution is recovered from zone 15. Note that the cycle time is increased from 76 to 86 minutes as two zones are incorporated into previous profile to allow glucose and fructose to further migrate through added zones toward the end of respective profile. The table 7 has listed the composition and concentration of retrieved raffinate and product, which demonstrates the ultimate separation results are obtained on both raffinate and product with elevated concentration. The concentration of nearly pure fructose product is elevated to over 51 D.S. % as indicated.

TABLE 7

| Zone | Total Output | D.S. % | Recovery % | Glucose % | Fructose % |
|---|---|---|---|---|---|
| 2 | 14.1520 grams | 35.7 | 100% of glucose | 100.00 | 0.00 |
| 15 | 11.9253 grams | 51.55 | 100% of fructose | 0.015 | 99.985 |

EXAMPLE 8

To handle 200 gallons per minute of 60% D.S. feed throughput; typical industrial unit of SMB process is designed as four columns having each in dimensions of 14 feet in I.D. and 27.5 feed in height. Each column is loaded with 4125 cubic-ft, or, 30,855 gallons per column, which is total of 123,420 gallons resin stock. The process requires 350 gallons per minute input rate of eluent water to retrieve a product stream of 88% fructose recovery as purity comprising of 90% fructose and 10% glucose. The comparison between SMB process and current disclosure is made in terms of resin stock and eluent consumption based on same throughput and feed composition. As indicated in example 7, the volume ratio of water to feed is 1.49%; it means 298 gallons of eluent water is required based on 200 gallons throughput. The current disclosure has 85% water consumption compared to 350 gallons in traditional SBM process.

The volume ratio of feed input to bed volume is 0.258. The cycle time is 86 minutes in last example, which is equivalent to 86 minimal time intervals. The resin stock required for 86 minutes cycle time is calculated by 200 divided by 0.258 then times 86, which is equivalent to 66,666.7 gallons to handle 200 gallons per minute feed throughput. In comparison to 123,420 gallons used up in SMB process, the result obtained from last example consumes only 54% of resin based on same feed throughput. Furthermore, the cycle time relevant to obtaining results demonstrated in previous examples can be used to calculate the required resin stock installation in said apparatus in order to retain the separation results from protocols illustrated in corresponding examples.

The corresponding profile obtained from earlier illustrated examples shows that each profile has different cycle time, which is depending on the quantity of recycle zones. Such cycle time translates to a needed amount of resin installed in apparatus in order to obtain specific concentration and composition of raffinate of glucose enriched solution and product of fructose enriched solution. Likewise, a comparison criterion can be predetermined respectively for a target raffinate and product, which has specific concentration and composition. Therefore, according to such comparison criterions, particular elution profile can be created through single cell evaluation to obtain said comparison criterions as the target raffinate and product. The corresponding differential set-up protocol and single stage recycle procedures can be established thereafter to obtain a raffinate of glucose solution and a product of fructose enriched solution that are satisfied with the target comparison criterions. The pure glucose and pure fructose illustrated in example 8 is the extreme option for ultimate separation of glucose and fructose. Yet, as indicated previously, the concentration of pure glucose can be further enhanced to between range of 50 and 60 D.S. % from concentration range between 30 and 40 D.S. % in previous 17-zone profile by adding additional zone to as 18-zone profile. However, the cycle time increases and the corresponding resin installation in apparatus increases accordingly.

I claim:

1. A method for separating glucose and fructose and oligosaccharide components from a liquid phase feed solution containing said components by sorption and sequential desorption from a permeable absorbent solid phase packing material with sequential delivery of said feed solution and a plurality of recycled solution mixtures and an eluent into a group of cells having at least wherein cell, and each cell contains equal amount of said solid phase packing material and has an inlet on one side of the solid phase packing material for liquid delivery and an outlet on another side of the solid phase packing material for liquid collection, the method comprises:

(a) obtaining at least one differential set-up protocol wherein each of said protocols is for establishing a particular single stage recycle procedure; wherein said differential set-up protocols are obtained by conducting a start up study and then a steady state study through single cell evaluation to produce at least one differential sorption and desorption profile and each profile develops a particular single stage recycle procedure which corresponds to a particular differential set-up protocol, wherein said single cell evaluation includes:

i. providing a study cell containing said solid phase packing material retained on a meshed filter and having an inlet on one side of the packing material and an outlet on an opposite side of the packing material;

ii. sequentially delivering one kind of liquid among all liquids arranged in specified order, which includes said feed solution and a plurality of recycled solution mixtures where an eluent, and each liquid is intermittently delivered according to a format in a plurality of differential amounts into the inlet of study cell while draining the delivered liquid to maintain the packing material in a partial dry status in which the surface of the material is wet but the liquid is drained from interstices of the material; and further wherein during delivery the liquid is drained through said permeable absorbent solid phase packing material, the mass transfer is completed; wherein said mass transfer includes the sorption of said components contained in the liquid phase material onto the solid phase packing material and the desorption of absorbed components from the solid phase packing material to the liquid phase material;

iii. collecting the retrieved solution mixtures and determining the relative composition and concentration of said components in each mixture to develop a sorption and desorption profile for a corresponding said differential set-up protocol to establish a particular single stage recycle procedure, wherein said protocol comprises a sequential delivery schedule of differential amounts of said liquid phase feed solution, said plurality of liquid mixtures for recycling and said eluent, wherein said profile comprises steady relationships between said solid phase packing material and retrieved solution mixtures which include a raffinate of glucose enriched solution and a product of fructose enriched solution and a plurality of solution mixtures for recycling, wherein both retrieved raffinate of glucose enriched solution and product of fructose enriched solution satisfy respectively a comparison criterion which including the concentration and composition of said components in said feed solution; and (b) implementing single stage recycle procedures through a selected differential set-up protocol to repeatedly repeat a separation cycle to simultaneously separate and enhancing concentration level of a raffinate of glucose enriched solution and a product of fructose enriched solution from said liquid phase feed solution, wherein said single stage recycle procedures include providing a group of cells arranged in a bundle and providing a plurality of holding tanks, wherein each tank contains one kind of liquid mixture which is determined from the corresponding said differential set-up protocol said in step (iii) of step (a), including said feed solution and an eluent and a plurality of said solution mixtures for recycling, each of which has steady characteristics of specific concentration and composition of said components in liquid phase feed solution; where each cell contains an equal amount of said solid phase packing material retained on a meshed filter and has an inlet on one side of the solid phase packing material to sequentially receive, during a particular range of time, one kind of liquid mixture delivered from corresponding holding tank according to said sequential delivery schedule of differential amounts; and each cell has an outlet under on the other side of the solid phase packing material to sequentially distribute, during same particular time range, one kind of said solution mixture into a designated holding tank, which solutions are a raffinate of glucose enriched solution and a product of fructose enriched solution, and a plurality of solution mixtures arranged in specified order for recycling, each of which has same steady characteristics of composition and concentration prior to a repeated separation cycle; and further wherein, while draining the delivered liquid, the packing material maintains a partial dry status in which the surface of the material is wet but the liquid is drained from interstices of the material; and further during delivery the liquid is drained through said absorbent solid phase packing material, the mass transfer is completed, wherein said mass transfer includes the sorption of said components contained in the liquid phase material onto the solid phase packing material and the desorption of absorbed components from the solid phase packing material to the liquid phase material.

2. The method of claim 1 wherein said solid phase packing material in one cell is a strongly acidic cation exchanger of one alkaline earth metal base retained on a porous mesh screen.

3. The method of claim 2 wherein said solid phase packing material in one cell is a calcium base strongly acidic cation exchanger retained on a porous mesh screen.

4. The method of claim 1 wherein said liquid phase feed solution is an aqueous liquid solution containing dissolved components of glucose, fructose, and oligosaccharide in concentration between 10 percent and 70 percent of total dry solid.

5. The method of claim 4 wherein said aqueous liquid solution contains said dissolved components in dirt-free water, and is free of ionic substances that would hinder the sorption capacity of the solid phase packing material contained in one cell.

6. The method of claim 1 wherein the eluent is dirt-free water and is free of ionic substances that would hinder the sorption capacity of the solid phase packing material contained in the cell.

7. The method of claim 1 wherein steps of obtaining at least one differential set-up protocols by conducting start up study and then steady state study for single stage recycle procedures through single cell evaluation comprise performing such studies through common steps of a new mass transfer method, wherein the common steps comprise:

(i) intermittently delivering one liquid phase solution during a first time period into the inlet of the cell;

(ii) intermittently supplying pressurized gas to the cell on the inlet side of the solid phase packing material following each delivery of said liquid phase solution during a second time period to increase the flow rate of the liquid phase solution through the solid phase packing material;

(iii) maintaining a vacuum to the cell on the outlet side of the solid phase packing material to maintain said solid phase packing material in partial dry status, wherein partial dry status is defined as the majority of delivered liquid phase solution having been drained off in parts by the vacuum and the pressurized gas during the second time period; and (iv) intermittently collecting treated liquid phase solution from the outlet of the cell during a third time period, wherein the sum of the first, second, and third time periods defines a minimal time interval.

8. The process of claim 7 wherein said pressurized gas is pressurized air.

9. The method of claim 7 wherein the inlet is above the outlet of the cell, and wherein the steps (i) through (iii) form a wet region of solid phase packing material contained in the cell and force draining of said liquid phase material through the solid phase packing material to promote mass transfer contact during the sum of the first time period and the second time period, wherein the mass transfer includes the sorption of said components contained in the liquid phase material onto the solid phase packing material and the desorption of absorbed components from the solid phase packing material to the liquid phase material.

10. The method of claim 7 wherein said steps of obtaining at least one differential set-up protocol by conducting a start up study and then a steady state study for single stage recycle procedures through single cell evaluation comprise:

(a) determining bonding capacity between a prefixed volume of liquid phase feed solution and an amount of partial dry solid phase packing material that is required for exact saturation with said prefixed volume of liquid phase feed solution within a shortest possible time;

(b) proportionally increasing such bonding capacity with a prefixed throughput of feed solution and disposing the determined amount of solid phase packing material in a cell;

(c) conducting said start up study through the common steps (i) through (iv) during each successive minimal time interval of the new mass transfer method by loading the prefixed throughput indicated in step (b) for the absorption of said components onto the solid phase packing material contained in the cell, then by desorption of the absorbed components with an eluent, and meanwhile sequentially collecting the efflux from the outlet of the cell to produce an elution profile; and (i) combining the collected effluxes in order collected as a plurality of liquid mixtures for recycling into next cycle study;

(ii) further conducting the next cycle study through the common steps (i) through (iv) during each successive minimal time interval of the new mass transfer method by intermittently and sequentially delivering said liquid mixtures in order as gathered between a range of second liquid mixture and the feed solution, wherein the feed solution is delivered in between two recycled mixtures having the glucose content slightly higher and slightly lower than that in feed solution, then, the remaining recycled liquid mixtures in order as gathered, followed by an eluent, and finally by the first liquid mixture, and meanwhile sequentially collecting the efflux from the outlet of the cell to produce an elution profile by determining the relative concentration and composition of the retrieved efflux;

(iii) combining the collected effluxes from step (ii) in parts as order collected as the, same plurality of liquid mixtures obtained in step (i), for recycling into next cycle study;

(iv) repeating step (ii) and then step (iii) until a steady profile been obtained, wherein the steady profile means that the concentration and composition of combined liquid mixtures remain steady between the study of current cycle and its previous cycle to conclude said start up study, and setting aside the second liquid mixture as raffinate of glucose enriched solution and the second to the last liquid mixture as product of fructose enriched solution, then reserving the remaining liquid mixtures as a plurality of liquid mixtures for recycling into next cycle in the steady state study; and (d) conducting said steady state study through the common steps (i) through (iv) during each successive minimal time interval of the new mass transfer method by intermittently and sequentially delivering said liquid mixtures in order as gathered between a range of a third liquid mixture and the feed solution, wherein the feed solution is delivered in between two recycled mixtures having the glucose content slightly higher and slightly lower than that in feed solution, then, the remaining recycled liquid mixtures in order as gathered, following by an eluent, and finally by the first liquid mixture; and (i) breaking down each required partial time according to the collected effluxes, in order collected, for each delivered liquid mixture and meanwhile producing an elution profile by determining the relative concentration and composition of retrieved efflux, wherein said profile includes a raffinate of glucose enriched solution, a plurality of liquid mixtures in a particular order for recycling into next cycle test, and a product of fructose enriched solution;

(ii) expanding said plurality of recycled liquid mixtures by replacing the retrieved raffinate and product with a liquid mixture having a particular composition and a finite concentration respectively and setting aside the retrieved raffinate and product;

(iii) recording a respective composition and concentration of the whole spectrum of the expanded liquid mixtures;

(iv) proceeding further study through said common steps (i) through (iv) during each successive minimal time interval of the new mass transfer method by intermittently and sequentially delivering said expanded recycled liquid mixtures between a range of second liquid mixture and the feed solution, wherein the feed solution is delivered in between two recycled mixtures having the glucose content slightly higher and slightly lower than that in feed solution, then, the remaining recycled liquid mixtures in order as gathered, following by an eluent, and finally by the first liquid mixture, and meanwhile sequentially collecting the efflux from the outlet of the cell to produce an elution profile by determining the relative concentration and composition of retrieved efflux;

(v) recording the partial time required for the respective delivered liquid for said profile obtained from step (iv), wherein the profile comprises a spectrum of liquid mixtures arranged in order collected, which comprise a raffinate of glucose enriched solution, a plurality of liquid mixtures for recycling, and a product of fructose enriched solution;

(vi) repeating steps (ii) through (v) if the retrieved raffinate and product fail to satisfy a comparison criterion which has a specific concentration and composition of said components in feed solution; and (e) dividing each partial time required for respective liquid delivery of said profile obtained from step (v) of step (d) by said minimal time interval to obtain the number of doses as the particular range of time zone for corresponding liquid delivery;

(f) dividing the volume of such liquid by the number of doses to obtain the partial volume required for each dose;

(g) further dividing said amount of resin in step (b) by a number that represents a group of partial cells to simultaneously receive the further partial volume for each partial cell in said group of partial cells;

(h) allocating and recording the respective time zone required for each mobile phase in step (e) for such liquid delivery;

(i) sequentially arranging all time zones in the same order for all of the kinds of delivered liquids in a closed loop format as one separation cycle; and (j) further sequentially preparing a sufficient amount of the whole spectrum of liquid mixtures, obtained in step (iii) of step (d), in a matching holding tank for supporting liquid distribution in the single stage recycle procedures, wherein said single stage indicates providing a group of cells arranged in a bundle, each cell having an inlet on one side of the solid phase packing material to sequentially receive one kind of liquid mixture delivered from respective holding tank and an outlet on another side of the solid phase packing material in the same while to sequentially distribute the drained liquid into a designated holding tank during the particular range of time zone, wherein the range of time zone is defined in steps (e) through (i).

11. The method of claim 10 wherein the eluent is dirt-free water and is free of ionic substance that would hinder the sorption capacity of the solid phase packing material contained in the cell.

12. The method of claim 10 wherein said in step (ii) of step (d) for expanding a plurality of recycled liquids by replacing the retrieved raffinate and product with a liquid mixture having respective composition same as the retrieved raffinate and product, has respective concentration between a range of 40 percent and 60 percent of dry solid content.

13. The method of claim 10 wherein said a number representing a group of partial cells in step (g) is a finite whole number equal to or greater than one.

14. The method of claim 10 of the step (vi) in step (d), wherein said comparison criterion for the retrieved raffinate is a glucose enriched solution having finite concentration between 25 percent and 60 percent dry solid content with glucose composition between 75 percent and 100 percent, and wherein said comparison criterion for the retrieved product is a fructose enriched solution having finite concentration between 25 and 60 percent dry solid content with fructose composition between 75 percent and 100 percent.

15. The method of claim 14 wherein said comparison criterion for the retrieved raffinate is a pure glucose in a finite concentration between 25 percent and 60 percent dry solid content and said comparison criterion for the retrieved product is a pure fructose in a finite concentration between 25 percent and 60 percent dry solid content.

16. The method of claim 10 wherein said single stage recycle procedures implemented through said differential set-up protocol are conducted with the common steps of a new mass transfer method, a method that is different from chromatography by eliminating the displacement zone and utilizing available void volume in chromatography, wherein the common steps comprise:

(i) intermittently delivering one liquid phase solution during a first time period into the inlets of each a group of cells;

(ii) intermittently supplying pressurized gas to the cell on the inlet side of the solid phase packing material following each delivery of said liquid phase solution during a second time period to increase the flow rate of the liquid phase solution through the solid phase packing material;

(iii) maintaining a vacuum to the cell on the outlet side of the solid phase packing material to maintain said solid phase packing material in partial dry status, wherein partial dry status is defined as the majority of delivered liquid phase solution having been drained off in parts by the vacuum and the pressurized gas during the second time period; and (iv) intermittently collecting treated liquid phase solution from the outlets of the group of the cells during a third time period, wherein the sum of the first, second, and third time periods defines a minimal time interval.

17. The method of claim 16 wherein said pressurized gas is pressurized air.

18. The method of claim 16 wherein the inlets are above the outlets of the group of cells, and wherein the steps (i) through (iii) form a wet region of solid phase packing material contained in each cell and force draining of said liquid phase material through the solid phase packing material to promote mass transfer contact during the sum of the first time period and the second time period, wherein the mass transfer includes the sorption of said components contained in the liquid phase material onto the solid phase packing material and the desorption of absorbed components from the solid phase packing material to the liquid phase material.

19. The method of claim 16 wherein said single stage recycle procedures implemented through said differential set-up protocol are for completion repeated separation cycle by sequentially delivering all of the kinds of liquid mixtures by starting from the third liquid mixture designated as first time zone, which is now defined as current time zone; and all of the kinds of said recycled liquid mixtures are arranged in specified ascending order between a range of the third liquid mixture and the feed solution, wherein the feed solution is delivered in between two recycled mixtures having glucose content slightly higher and slightly lower than that in the feed solution, then, the remaining recycled liquid mixtures, followed by an eluent, and finally by the first liquid mixture; and meanwhile designating a holding tank containing said first liquid mixture for corresponding drained liquid collection as the current holding tank; wherein said recycle procedures comprise:

(a) conducting steps (i) through (iv) during each successive minimal time interval of said common steps of an operating cycle during the current time zone, wherein step (i) delivers a dose of corresponding liquid mixture from the matching holding tank, and wherein step (iv) collects drained liquid into said current holding tank;

(b) at the completion of step (iv), repeating step (a) then step (b) until the number of doses as the particular range of current time zone for the corresponding liquid delivery is completed;

(c) switching to next time zone, now is defined as current time zone, for corresponding liquid delivery from the matching holding tank and designating a holding tank with ascending order next to the previous designated holding tank as the current holding tank for corresponding drained liquid collection; and (d) repeating step (a), step (b), then step (c) until all kinds of recycled liquid mixtures including feed solution and eluent have been delivered in specified ascending order and various liquid streams have been collected into respective holding tanks prior to starting another separation cycle, wherein liquid streams comprise in part of a raffinate stream of glucose enriched solution, a plurality of liquid streams in specified order for recycling into next separation cycle, and a product stream of fructose enriched solution.

20. The method of claim 19 wherein said step (d) comprises sequentially retrieving a raffinate stream is a glucose enriched solution having finite concentration between 25 percent and 60 percent dry solid content with glucose composition between 75 percent and 100 percent, and retrieving a product stream that is a fructose enriched solution having finite concentration between 25 percent and 60 percent dry solid content with fructose composition between 75 percent and 100 percent, and sequentially retrieving a plurality of liquid mixtures for recycling into next cycle mixture having steady characteristics in glucose and fructose composition and finite concentration.

21. The method of claim 20 wherein said retrieved raffinate is a pure glucose in a finite concentration between 25 percent and 60 percent dry solid content, and wherein said retrieved product is a pure fructose in a finite concentration between 25 and 60 percent dry solid content.

22. The method of claim 19 wherein the eluent is dirt-free water and is free of ionic substance that would hinder the sorption capacity of the solid phase packing material contained in the cell.

23. The method of claim 16 wherein said the step (ii) performed during a second time period is conducted without pressurized gas and vacuum is maintained constantly to drain the delivered liquid phase solution.

24. The method of claim 16 wherein said the step (ii) performed during a second time period is conducted with pressurized gas to increase the flow rate of delivered liquid phase solution through the solid phase material and the step (iii) performed during a second time period is conducted without vacuum.

25. The method of claim 16 wherein said the steps (ii) and (iii) performed during a second time period are conducted without vacuum and pressurized gas and wherein said delivered liquid phase solution flows by gravity through said solid phase packing material.

* * * * *